US005903289A

United States Patent [19]

Takayanagi

[11] Patent Number: 5,903,289

[45] Date of Patent: May 11, 1999

[54] CONTROL CIRCUIT OF A COMPACT RECORDING APPARATUS

[75] Inventor: Yoshiaki Takayanagi, Yokohama, Japan

[73] Assignee: Canon Kabushiki Kaisha, Tokyo, Japan

[21] Appl. No.: 08/183,405

[22] Filed: Jan. 19, 1994

[30] Foreign Application Priority Data

Jan. 19, 1993 [JP] Japan ..... 5-006969

[51] Int. Cl.[6] ..... B41J 2/21; B41J 29/38

[52] U.S. Cl. ..... 347/43; 347/13

[58] Field of Search ..... 347/43, 3, 13, 347/240, 237, 9, 12, 10

[56] References Cited

U.S. PATENT DOCUMENTS

| | | | |
|---|---|---|---|
| 4,829,323 | 5/1989 | Suzuki et al. . | |
| 5,111,217 | 5/1992 | Zeise | 347/240 |
| 5,132,702 | 7/1992 | Shiozaki et al. | 347/12 |
| 5,142,374 | 8/1992 | Tajika et al. | 347/15 |
| 5,223,937 | 6/1993 | Moriguchi et al. | 347/3 |
| 5,357,268 | 10/1994 | Kishida et al. | 347/13 |
| 5,477,245 | 12/1995 | Fuse | 347/10 |
| 5,617,122 | 4/1997 | Numata et al. | 347/14 |

FOREIGN PATENT DOCUMENTS

| | | |
|---|---|---|
| 0437062 | 7/1991 | European Pat. Off. . |
| 0595658 | 5/1994 | European Pat. Off. . |
| 55-074883 | 6/1980 | Japan . |
| 63-264359 | 11/1988 | Japan . |

*Primary Examiner*—N. Le
*Assistant Examiner*—Thinh Nguyen
*Attorney, Agent, or Firm*—Fitzpatrick, Cella, Harper & Scinto

[57] ABSTRACT

A head drive controller resets a counter which counts a clock signal in synchronism with a timing signal in synchronism with a discharge pulse signal, and raises the drive pulse-width signal which drives the nozzles of each color of the recording head 1. The controller makes the driving pulse-width signal fall in accordance with the result of comparators. The recording head which discharges a plurality of colors of ink records image data read from an image memory in a predetermined order. Accordingly, a compact printer capable of a color printing can provided at the low cost.

41 Claims, 13 Drawing Sheets

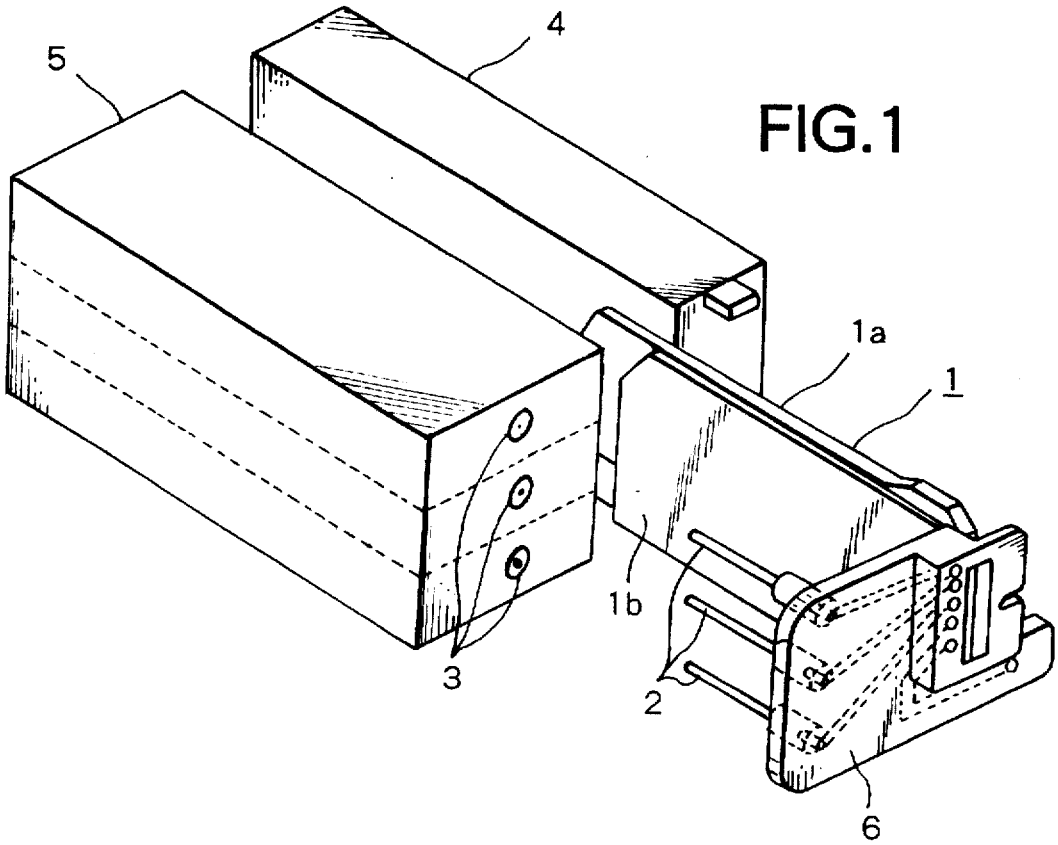
FIG.1
FIG.2A
(PRIOR ART)
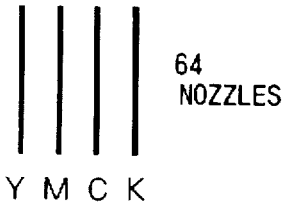
FIG.2B
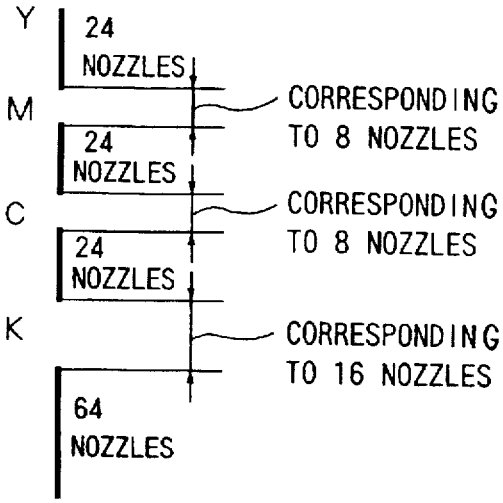

CONTROL CIRCUIT OF A COMPACT RECORDING APPARATUS

BACKGROUND OF THE INVENTION

The present invention relates to a recording apparatus, and more particularly, to control of a pulse which drives the head of a color ink-jet printer.

As shown in FIG. 14, a general construction of a color ink-jet printer is such that a plurality of recording heads 44*y*, 44*m*, 44*c* and 44*k* are respectively arranged in the direction which is perpendicular to the scanning direction of a carriage 45.

Along with recent spread of lap top or notebook type compact personal computers and improvement of color liquid crystal display technique, the display unit of a compact personal computer has a tendency to be colored. Under this circumstance, development of a compact printer capable of color printing has progressed rapidly.

However, the above-described ink-jet printer has drawbacks in that the width of a recording apparatus body is wide and a registration adjustment is required because the recording heads 44*y*, 44*m*, 44*c* and 44*k* are arranged in parallel to each other. Regarding the latter drawback in particular, in an apparatus whose recording heads can be exchanged by a user, a registration correction value which is unique to each recording head needs to be stored in a non-volatile memory in the recording head.

For the registration adjustment, a recording head and the other recording heads are driven in non-synchronism. Accordingly, a counter for controlling the pulse-width of a recording head drive pulse and a register are needed for each recording head, thus resulting in cost increase.

SUMMARY OF THE INVENTION

Accordingly, it is an object of the present invention not to perform registration adjustment in the main scanning direction, and to not use a non-volatile memory which stores registration correction values.

It is another object of the present invention to reduce the cost of the recording heads and printer as a whole by simplifying the control circuit of the recording heads.

In the above objects, a preferable embodiment discloses a color recording apparatus which performs recording by using the recording head whose recording elements corresponding to different colors are arranged in line, and a recording apparatus having a control circuit which controls the pulse-widths of the driving signals which are respectively supplied to the recording elements corresponding to each color by sharing a part of the control circuit.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated and constitute a part of the specification, illustrate embodiments of the invention and, together with the description, serve to explain the principles of the invention.

FIG. 1 is a perspective view illustrating the construction of a recording head and the periphery ink cartridges of an embodiment according to the present invention;

FIG. 2A is a diagram illustrating a conventional construction of nozzle group;

FIG. 2B is a diagram illustrating the construction of nozzle group of the embodiment;

DESCRIPTION OF THE PREFERRED EMBODIMENTS

Figure 3:
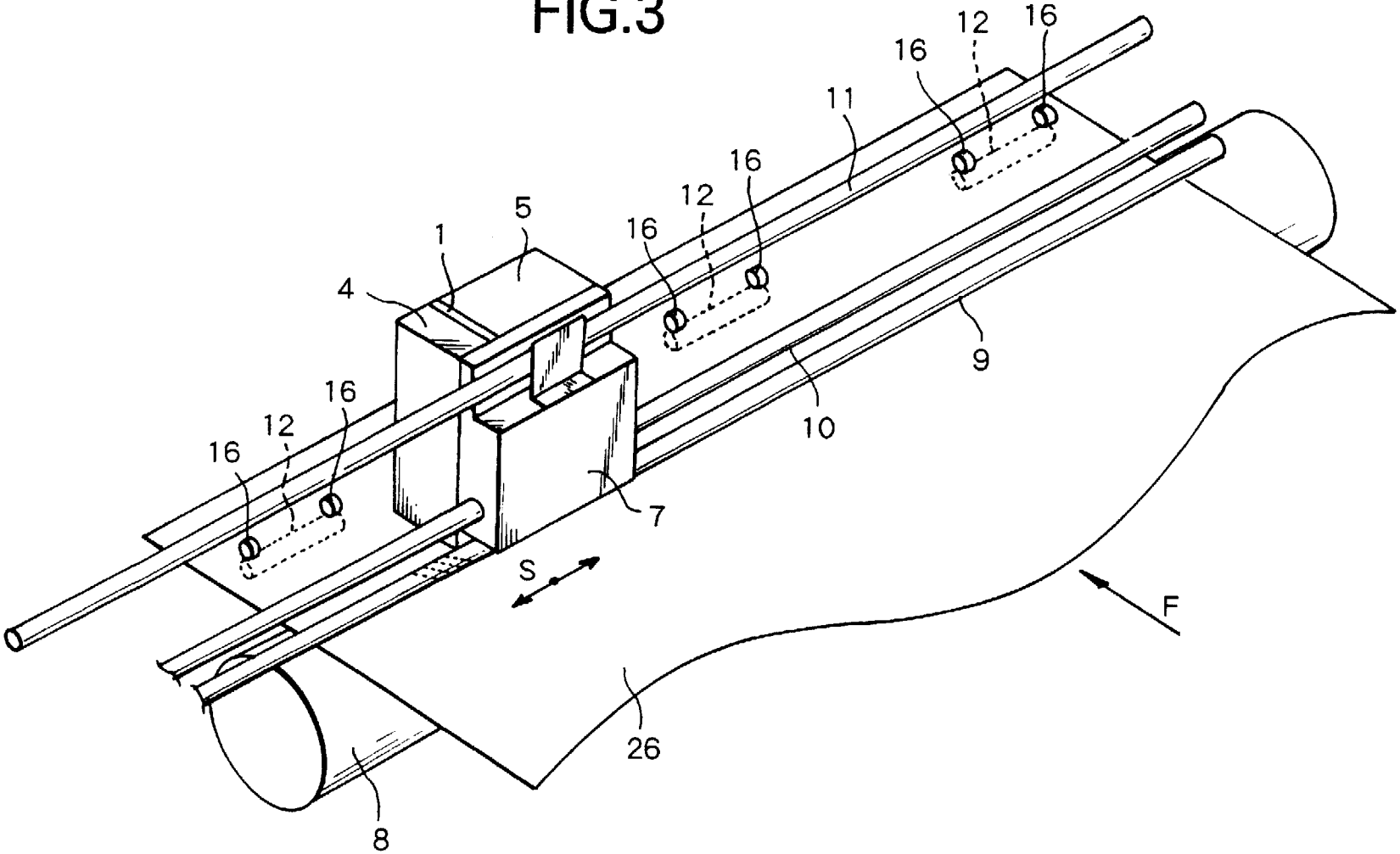
FIG. 3 is a perspective view illustrating an entire construction of the embodiment.

Preferred embodiments of the present invention will now be described in detail in accordance with the accompanying drawings.

[First Embodiment]

FIG. 1 is a perspective diagram illustrating the construction of a recording head and the periphery of ink cartridges of the embodiment, as seen from the side of the nozzles.

In FIG. 1, numeral 1 is a bubble-jet type recording head which discharges ink in accordance with a recording signal. Numeral 4 is an ink cartridge for black containing black (K) ink in which shape is substantially a rectangular parallelepiped. Numeral 5 is an ink cartridge for color containing yellow (Y), magenta (M) and cyan (C) inks in which shape is also substantially a rectangular parallelepiped. Furthermore, numerals 2 are ink supply pipes, numerals 3 are ink supply pores and numeral 6 is a distributor. The details of the above units are described later.

The construction of the recording head 1 is described below. As shown in FIG. 2B, groups of nozzles for Y, M, C and K are arranged perpendicular to the main scanning direction in line as recording elements. Each group of nozzles for Y, M and C is consisted of 24 nozzles and the group of nozzles for K is consisted of 64 nozzles. The spaces between Y and M, and M and C correspond to 8 nozzles respectively, while the space between C and K corresponds to 16 nozzles. In the nozzle group of the conventional recording head, 64 nozzles for each color are arranged in line and each group of nozzles are arranged at predetermined frequencies.

The discharge port at the tip of each nozzle is connected to an ink passage (ink fluid passage). Behind the portion where the ink passages are provided, a common fluid (liquid) chamber for supplying ink into the ink passages is provided.

In each ink passage, an electrothermal transducer which generates thermal energy used to discharge an ink droplet from the discharge port and an electrode wire which supplies electricity to the electrothermal transducer are provided. The electrothermal transducer and the electrode wire are formed, by a thin-filming technique, on a substrate comprised of silicon and the like. The above-described discharge port, ink fluid passage and common fluid chamber are formed on the silicon substrate by partitions and cover plate 1*b* made of resin and a glass member.

Further behind, a driving circuit which drives the electrothermal transducer is provided in the form of a print substrate. The print substrate is fixed on an aluminum plate (base plate) 1*a* with the silicon substrate.

The recording head 1 is supplied with ink from the ink cartridge 5 for color by connecting the ink supply pipe 2 provided for each color on the recording head 1 to the ink supply port 3 provided for each color on the side of the ink cartridge 5 for color. That is, the ink cartridges 4 and 5 are inserted into the aluminum plate in parallel and connected to the ink supply pipes 2 which are projected from the distributor 6. The distributor 6 made of resin is located substantially perpendicular to the aluminum plate 1*a*, and connected to the ink fluid passage in the distributor 6 which is further connected to the common fluid chamber.

Furthermore, as shown in FIG. 1, four ink fluid passages in the distributor 6 are provided for Y, M, C and K, which are respectively connected to the ink supply pipes 2. The ink supply pipes 2 are divided into three pipes as the ink cartridge 5 for various colors and the ink cartridge 4 for black are installed into the right and the left with respect to the aluminum plate 1*a*.

FIG. 3 is a perspective view illustrating the entire construction of an ink-jet printer of the embodiment which discharges ink droplets by thermal energy by using the above-described recording head 1 and ink cartridges 4 and 5.

In FIG. 3, numeral 7 is a carriage on which the recording head 1 and the ink cartridges 4 and 5 are fixed. The carriage 7 is supported by cylindrical guides 10 and 11, and reciprocates in the direction S along with both guides 10 and 11. In the movement of the carriage 7, a clearance of approximately 1 mm is always maintained between the discharge ports of the recording head 1 and a recording paper 26.

Numeral 9 is a lead screw, a part of which is connected to a motor (not shown) and rotated. The lead screw 9 engages with a lead pin (not shown) which is projected from the carriage 7. The carriage 7 moves in synchronism with the rotation of the lead screw 9.

Numeral 8 is a cylindrical paper feeding roller which co-operates with a pinch roller (not shown) and feeds the recording paper 26 in the direction F while gripping the paper 26 with the pinch roller.

Numeral 12 is a cylindrical paper ejection roller which grips the recording paper 26 fed by the paper feeding roller 8 with spurs 16 each of whose shape is a disk. The recording paper 26 is kept flat by applying a tension between the paper ejection roller 12 and the paper feeding roller 8.

The printing method of a color image by the recording head 1 is described below.

Figure 4:
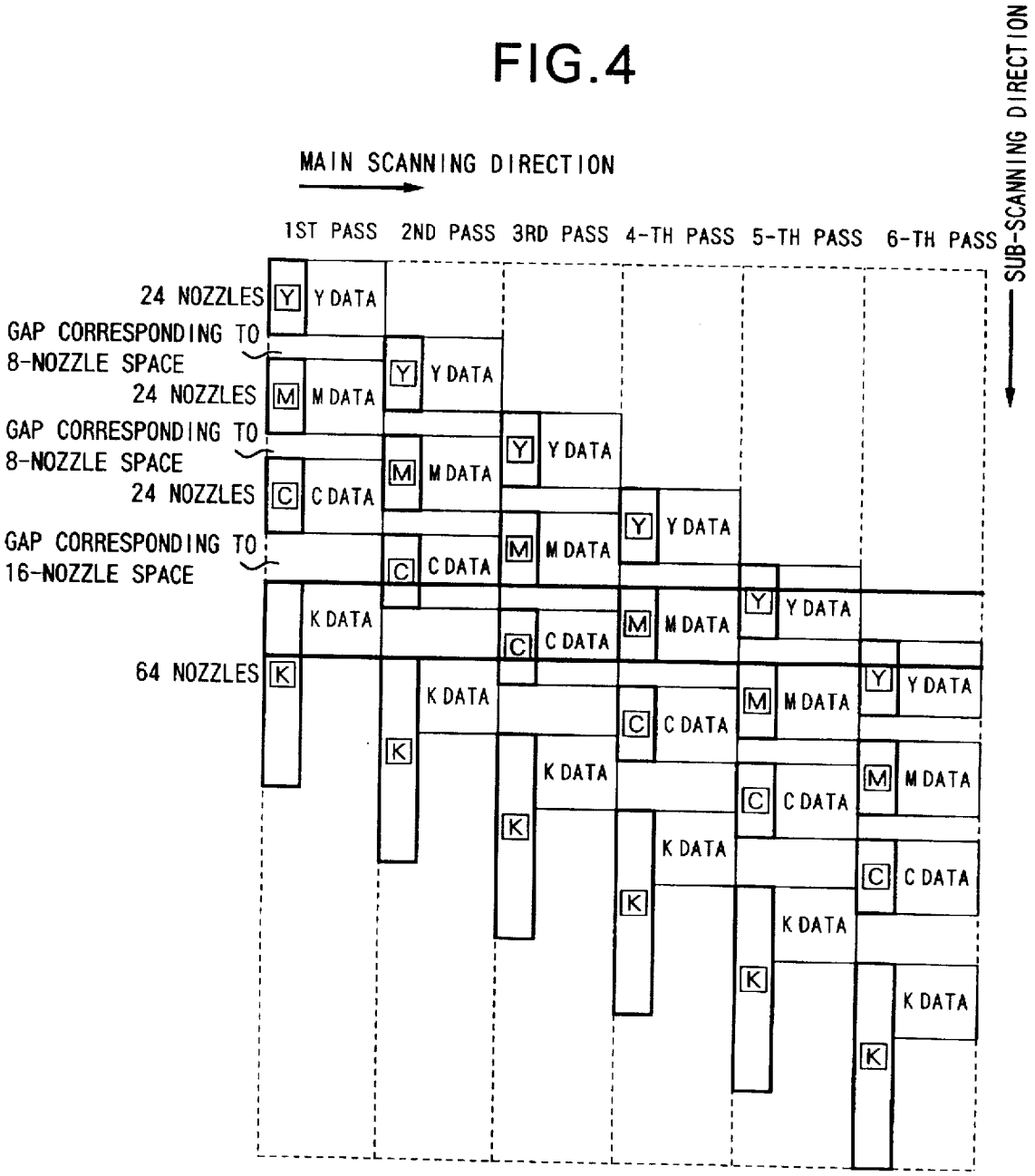
FIG. 4 is a model diagram for explaining a color image printing method of the embodiment.
Figure 5:
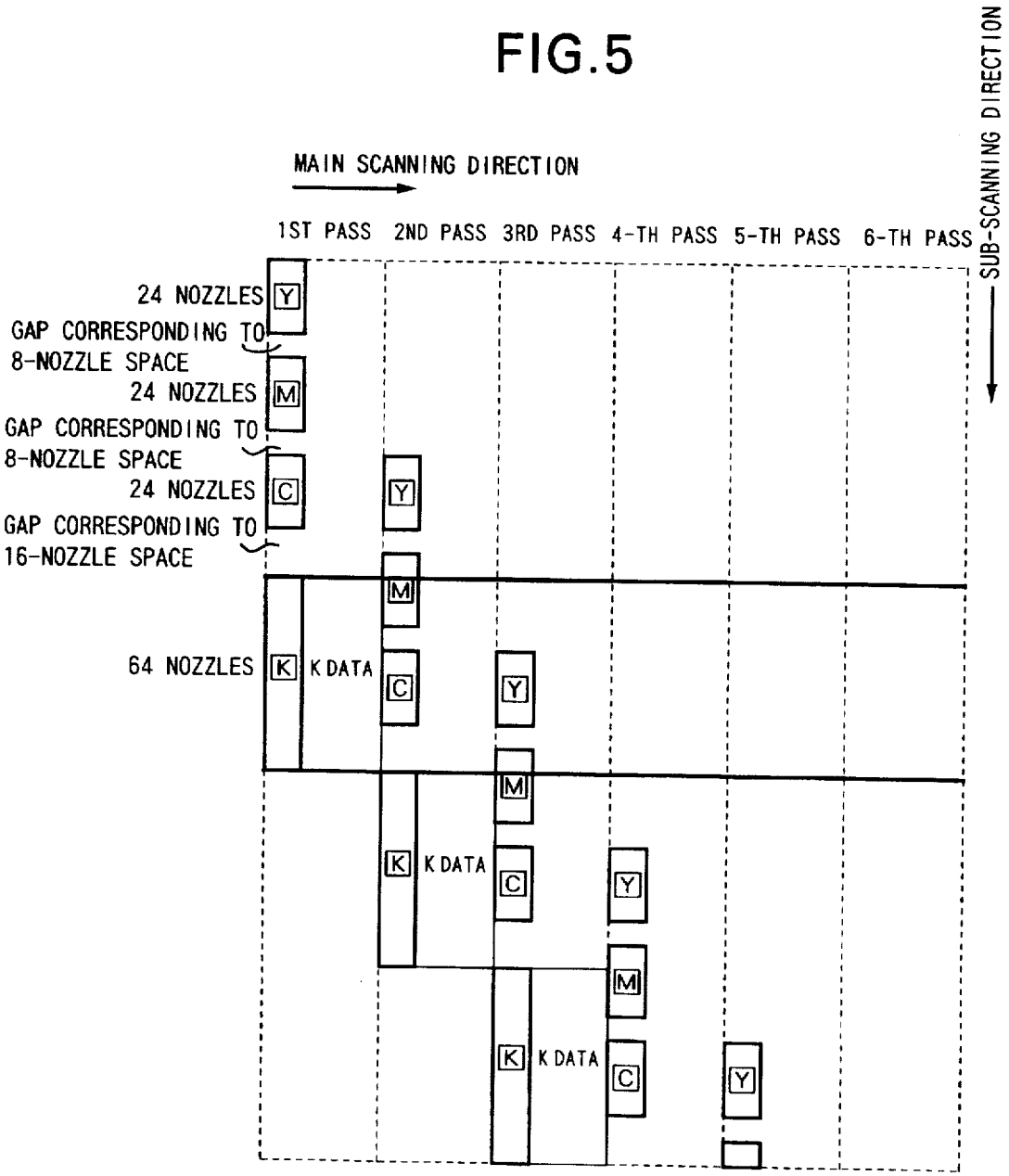
FIG. 5 is a model diagram for explaining a monochrome image printing method of the embodiment.
Figure 6:
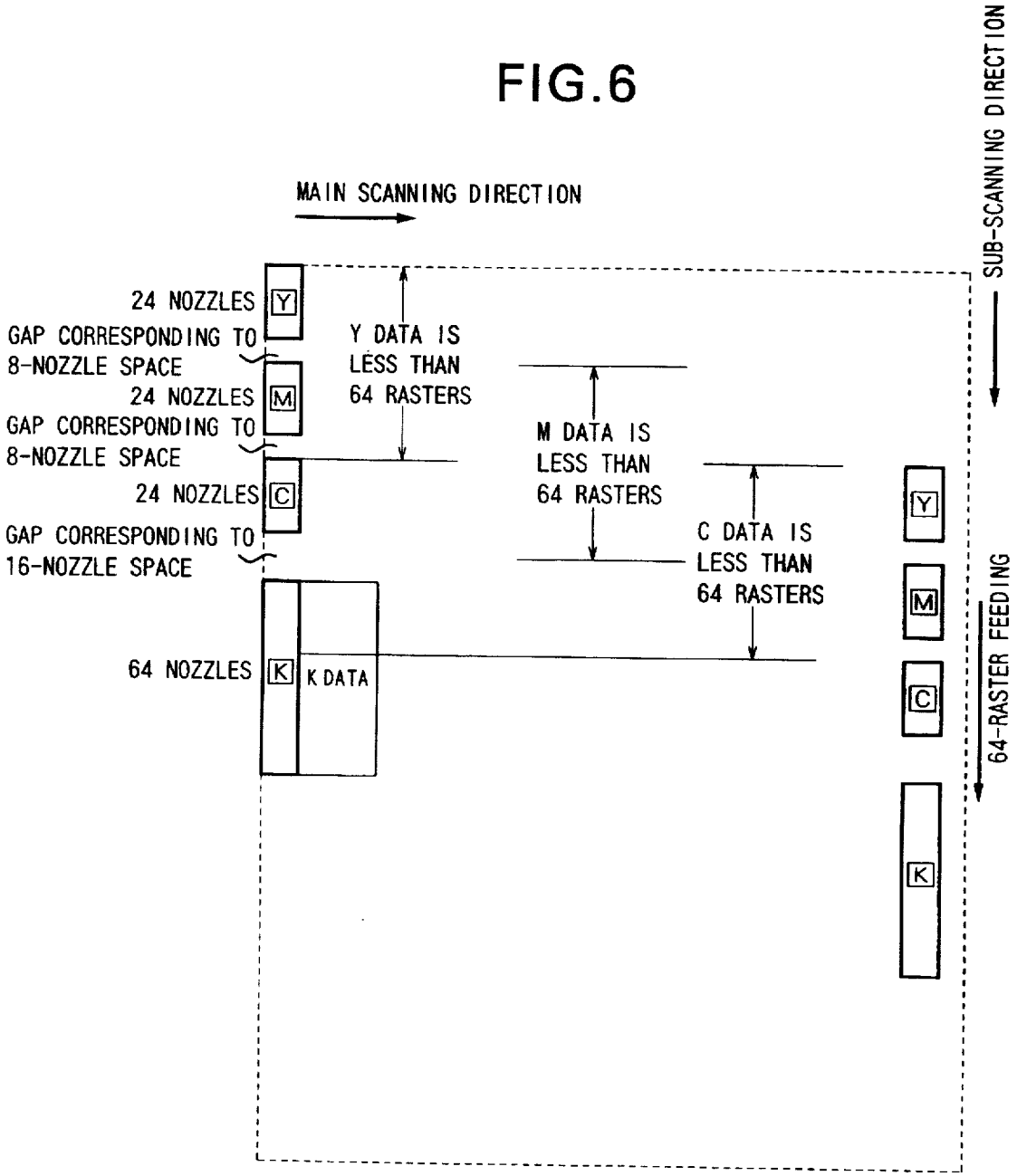
FIG. 6 is a model diagram for explaining a printing method when a monochrome image and a color image coexist in the embodiment.

FIG. 4 is a model diagram for explaining a color image printing method, FIG. 5 is a model diagram for explaining a monochrome image printing method, and FIG. 6 is a model diagram illustrating the case where a monochrome image and a color image coexist.

In FIG. 4, first pass, second pass, . . . refer to the scanning operation of the recording head 1 with respect to the width of the recording paper 26, that is, the main scanning operation is numbered. The recording paper 26 is fed in the direction which is perpendicular in the main scanning direction, that is, to the sub-scanning direction for the distance corresponding to 24 nozzles (1.69 mm) in each pass. For example, in a case of printing in black, as shown in FIG. 4, the first 24 nozzles of the nozzle group of K are used and the rest of 40 nozzles are not used.

Furthermore, as shown in FIG. 5, when a document including only characters/letters is printed, an area (a width) corresponding to 64 nozzles is printed in a single pass and the paper feeding is performed equal to a distance of 64 nozzles (4.51 mm), since the nozzle group of K is used without using the nozzle groups Y, M and C.

As apparent from the above description, in the embodiment, the printing speed of monochrome printing is approximately 2.7 times (64/24) faster than that of color printing.

Furthermore, in the embodiment, as shown in FIG. 6, when a monochrome image and a color image coexist, if there is no Y, M or C pixel in the next 64 rasters to be printed (that is, data for Y, M and C are respectively zero), the printing of 64 rasters is performed in one pass by using all nozzles in the nozzle group of K, and paper feeding for 64 rasters is performed. This is the same printing operation as that of the monochrome image, thus improving the printing speed.

Figure 7:
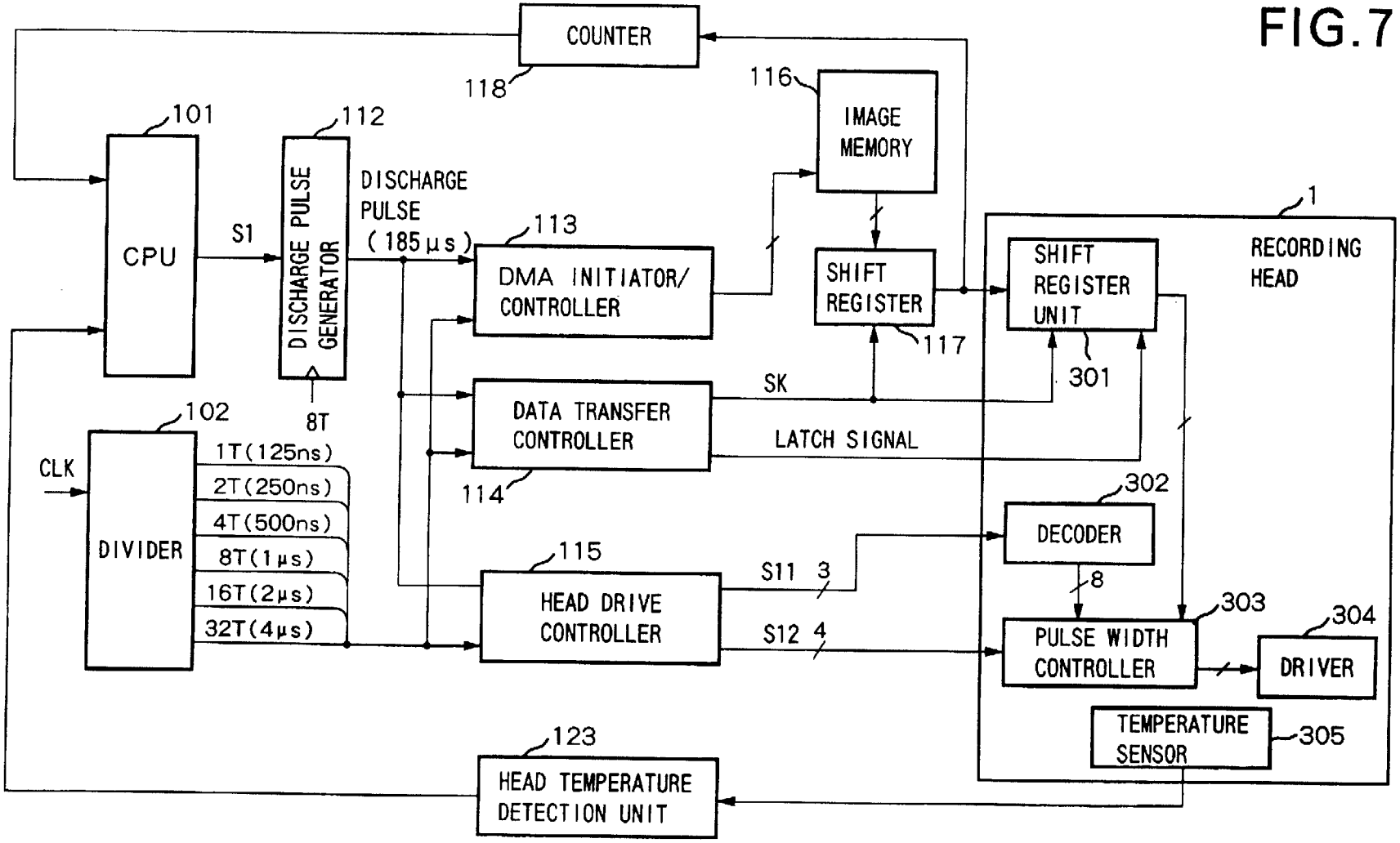
FIG. 7 is a block diagram illustrating the construction of a controller of the embodiment.

FIG. 7 is a block diagram illustrating the construction of a controller in the embodiment.

In FIG. 7, numeral 101 is a CPU which is comprised of a one-chip microprocessor including RAM and ROM, and controls each unit in accordance with programs stored in the ROM. The details of the processing executed by the CPU 101 is described later. Note that the CPU 101 and each unit are connected by a CPU bus, which is not shown in FIG. 7.

Numeral 102 is a divider which divides a clock CLK of 16 MHz to generate the clock needed for control, and the generated clock is supplied to each unit.

Numeral 112 is a discharge pulse generator which outputs a discharge pulse in synchronism with a clock 8T inputted from the divider 102 while a printing frequency signal Si inputted from the CPU 101 is active. The discharge pulse is a timing signal which controls an ink discharge frequency and a signal of 185 μs (5.405 kHz) frequency.

Numeral 113 is a DMA initiator/controller which sequentially reads image data from an image memory 116 in synchronism with the discharge pulse inputted from the discharge pulse generator 112. The image data read from the image memory 116 is subject to the DMA transfer and stored in a shift register 117.

Numeral 114 is a data transfer controller which supplies a shift clock SK to a shift register 117. The shift clock SK is a clock to output image data in each bit in serial from the shift register 117 in synchronism with the plurality of clocks inputted from the divider 102 and the discharge pulse inputted from the discharge pulse generator 112. The image data outputted from the shift register 117 is stored in a shift register unit 301 included in the recording head 1, and is transferred to a driver 304 included in the recording head 1 (the details are described later).

Numeral 115 is a head drive controller which outputs a signal to drive the recording head 1. The signals outputted from the head drive controller 115 are a 3-bit driving block signal S11 and a 4-bit driving pulse-width signal S12.

Numeral 123 is a head temperature detection unit which detects the temperature of the recording head 1 from the change of resistance value of the temperature sensor 305 comprised of aluminum wiring internally stored in the recording head 1, and transmits the detection result to the CPU 101. The CPU 101 instructs the head drive controller 115 so that an ink discharge amount (volume) will be constant with respect to the temperature change. The head drive controller 115 adjusts the pulse-width of a drive pulse-width signal S12 in accordance with the instruction of the CPU 101. Furthermore, if rank information indicating detection characteristics of the temperature sensor 305 is provided in the recording head 1, and the detected temperature is corrected based on the information, more accurate control is possible.

Furthermore, the temperature of the recording head 1 can be maintained to be substantially constant by controlling generation of heat in the recording head 1 through the CPU 101.

Numeral 118 is a counter which counts and accumulates the number of times of ink discharge from the shift register 117 in order to predict the remaining ink amount in the ink cartridge from the count value. In the embodiment, a temperature rise of the recording head 1 can be predicted from the count value of the counter 118. That is, control having high responsibility can be performed at high speed by monitoring the temperature of the aluminum plate 1*a*, predicting the temperature rise from the count value of the counter 118, and controlling a drive pulse-width.

Figure 8:
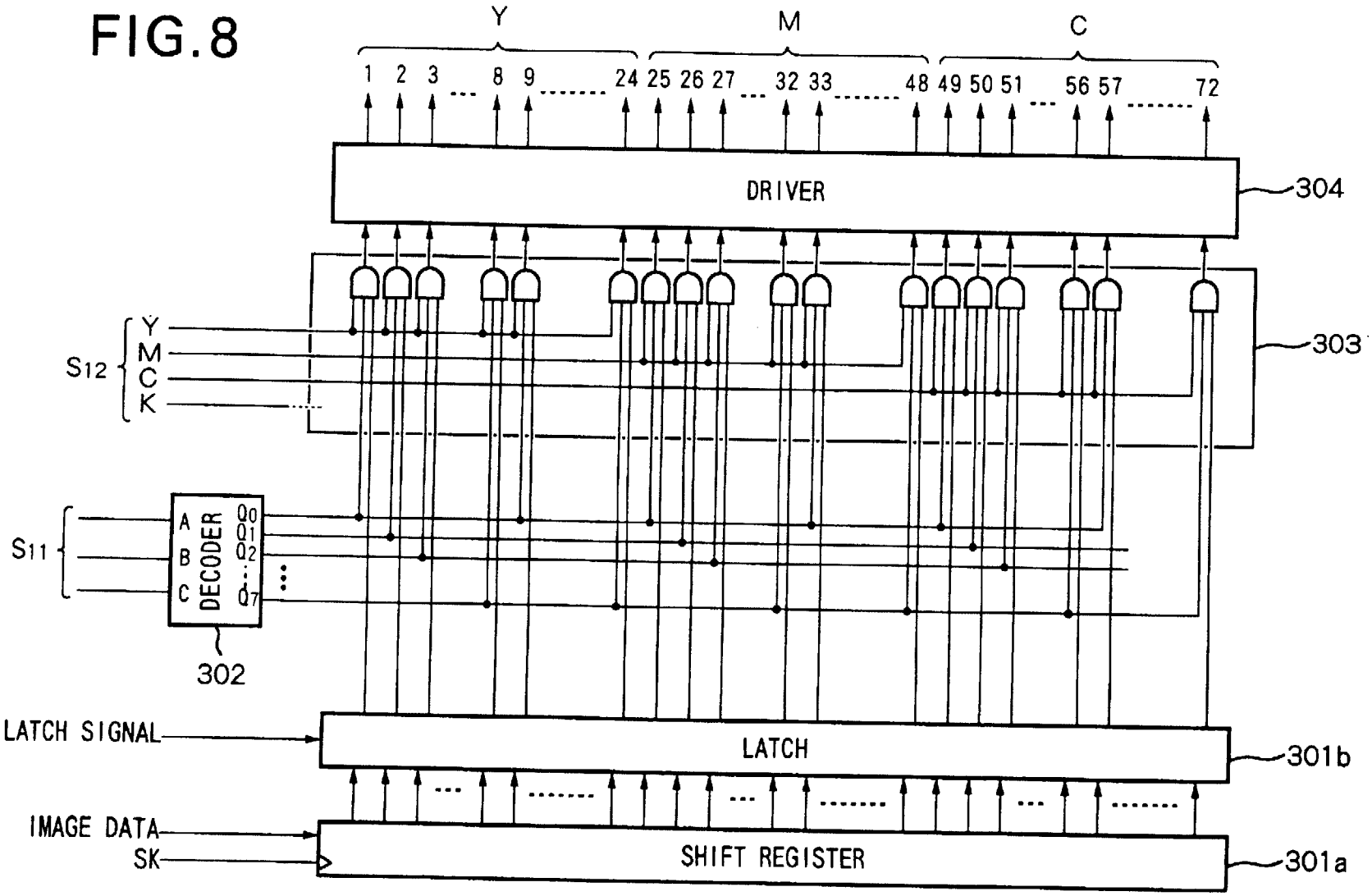
FIG. 8 is a block diagram illustrating the detailed construction of the nozzle drive circuit of the recording head shown in FIG. 7.

FIG. 8 is a block diagram illustrating the structure of the nozzle drive circuit of the recording head 1. The recording head 1 drives 72 nozzles for color printing by dividing 72 nozzles (24×3) into 8 blocks (9 nozzles/block). That is, since the blocks in every 8 nozzles are simultaneously driven, the nozzles for different colors are driven at the same time.

In FIG. 8, a signal S11 is inputted into a decoder 302 which activates one of eight outputs in accordance with the signal S11. The output of the decoder 302 is connected to nine different AND gates of a pulse-width controller 303.

On the other hand, each bit of the signal S12 is connected to 24 different AND gates of the pulse-width controller 303.

The image data is inputted into a shift register 301*a* and sequentially shifted by the shift clock SK inputted from the data transfer controller 114. The output of 72 bits of the shift register 301*a* is latched by a latch 301*b* and transmitted to the 72 AND gates of the pulse-width controller 303 in synchronism with the latch signal inputted from the data transfer controller 114.

Accordingly, the bit of a signal outputted from the driver 304 is activated when the outputs of image data and decoder 302 and the bit of the signal S12 are all active, and then, ink is discharged from the nozzle corresponding to the bit. That is, by controlling the drive pulse-width signal S12, the amount of ink discharge of each ink can be adjusted.

In FIG. 8, the construction of the driving circuit of nozzles for K is omitted, however, the operation is the same as that of nozzles for color except the shift register is reduced from 72 bits to 64 bits.

Figure 9:
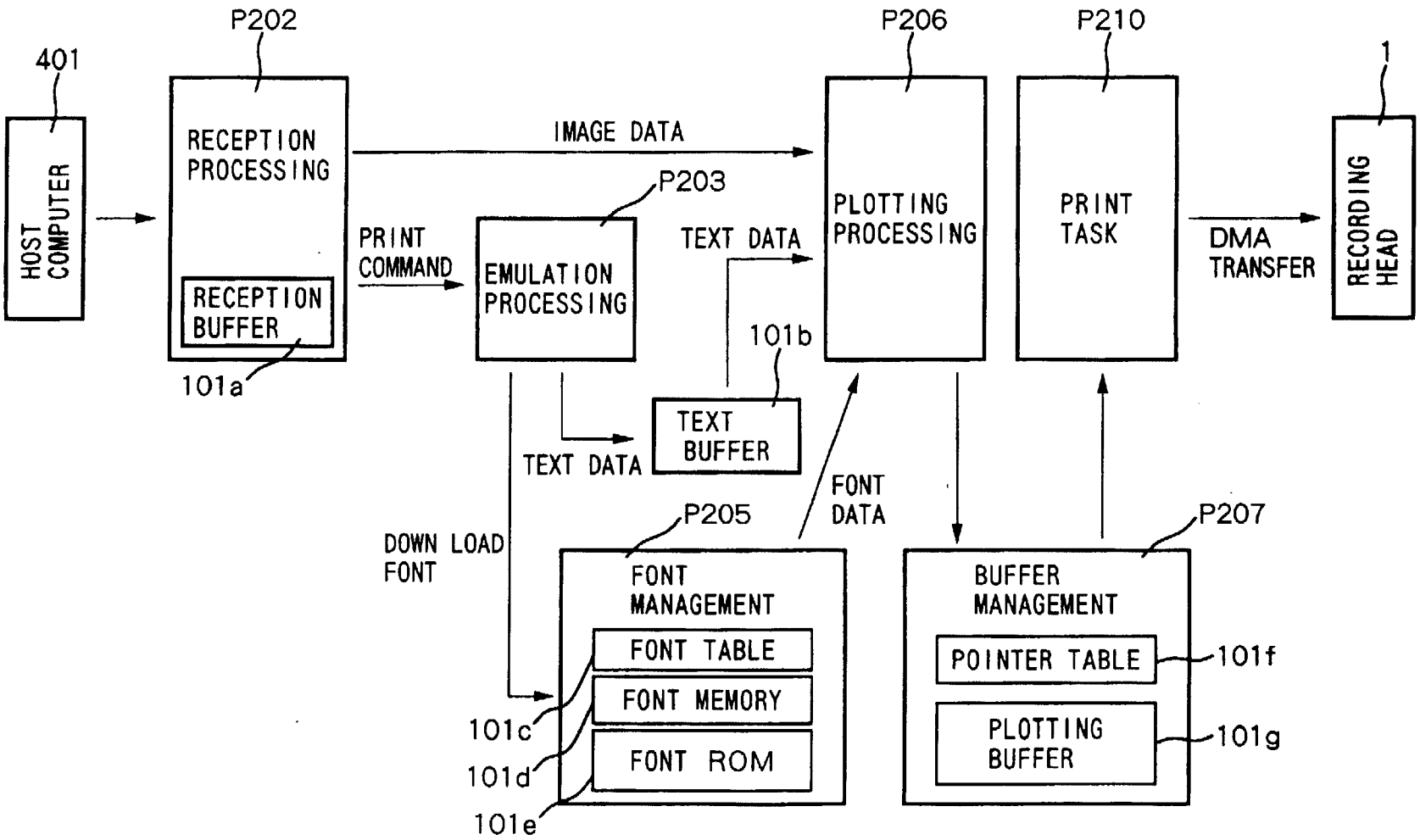
FIG. 9 is a data flow chart illustrating the control procedure executed by the CPU shown in FIG. 7.

FIG. 9 is a data flowchart indicating the control procedure of the CPU 101.

In FIG. 9, when the CPU 101 receives data from an external host computer 401 via a CENTRONIX interface, a reception buffer 101*a* temporarily stores the received data in reception processing P202.

In the reception processing P202, the image data is transferred to plotting (drawing, painting) processing P206, and data such as print command is transferred to emulation processing P203.

In the emulation processing P203, text data is subject to a command analysis and the separated data is transferred to the plotting processing P206 via a text buffer 101*b*. Similarly, separated down load font and print font commands are transferred to font management P205.

The font management P205 temporally stores the down load font in a font memory 101*d* managed by a font table 101*c*, and transfers kanji (character) font stored in a font ROM 101*e* and the font data stored in the font memory 101*e* such as to the plotting processing P206.

Accordingly, the plotting processing P206 receives the image data, text data and font data, and transfers image data formed from these data to a buffer management P207.

The buffer management P207 develops the image data transferred from the plotting processing P206 to a plotting image buffer 101*g* managed by a pointer table 101*f*. Note that the plotting image buffer 101*g* corresponds to the image memory 116 shown in FIG. 7.

The print task P210 is in synchronism with the movement of the carriage 7 shown in FIG. 3, and reads data to be plotted from the plotting image buffer 101*g*. The read image data is subject to the DMA transfer to the recording head 1. The DMA transfer is executed by control of the DMA initiator/controller 113.

The control of movement of the carriage 7 and paper feeding can be performed when the CPU 101 controls a carriage motor and line feed mode although they are not shown in FIG. 9.

Figure 10:
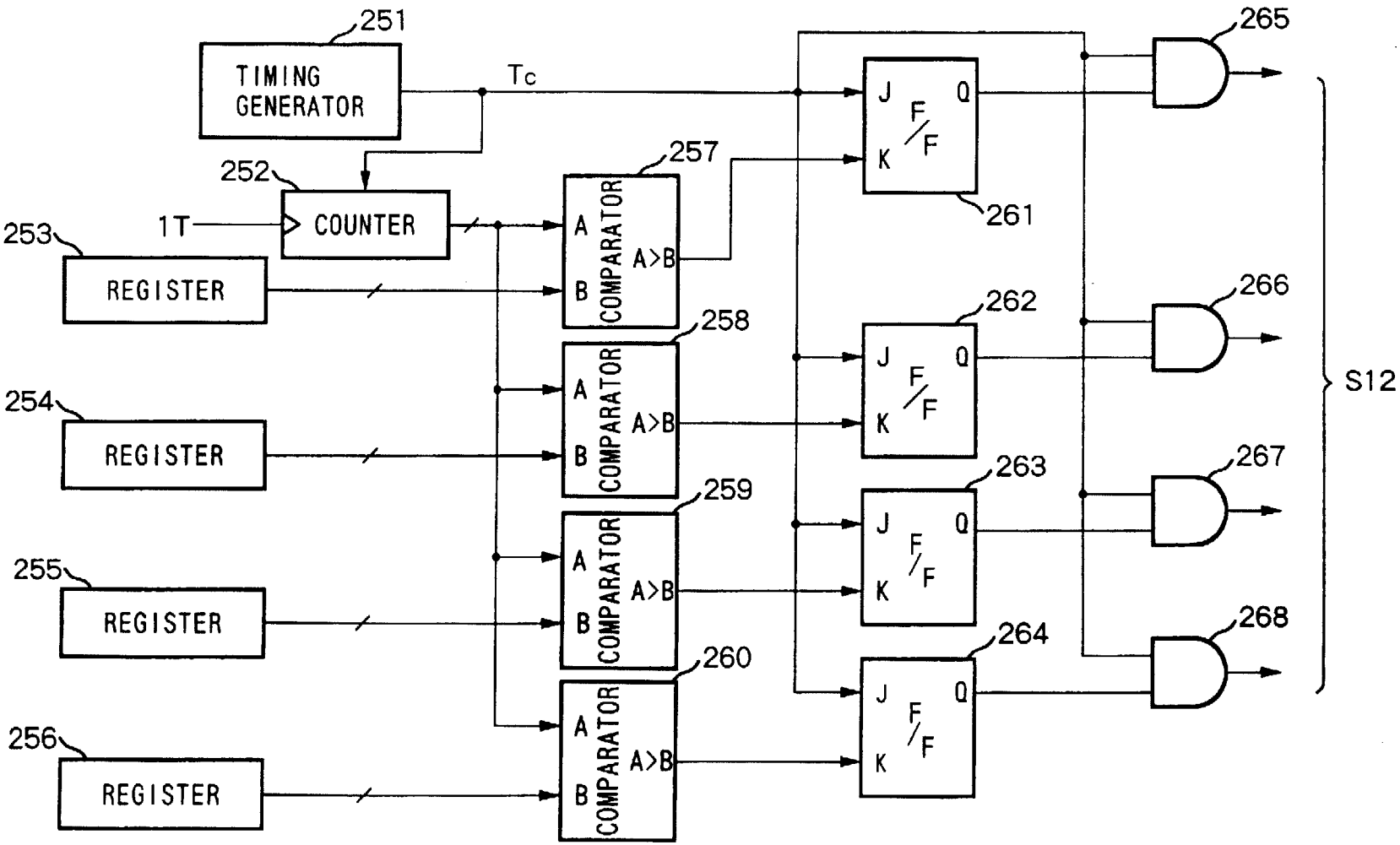
FIG. 10 is a block diagram illustrating the detailed construction of the head drive controller shown in FIG. 7.
Figure 11:
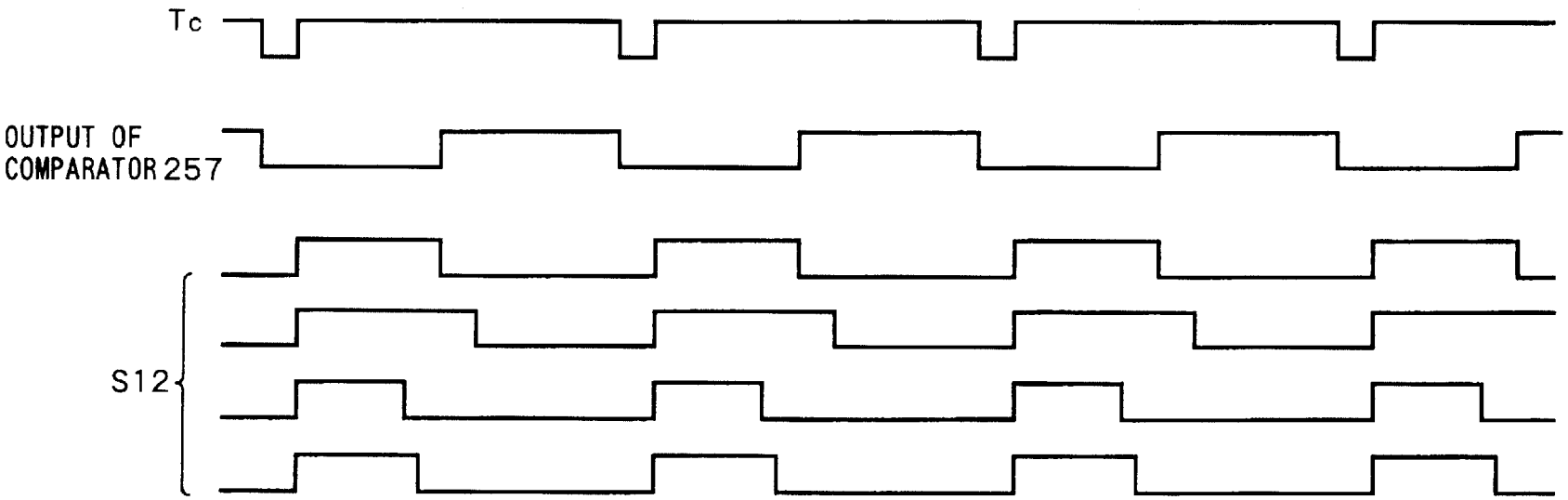
FIG. 11 is a timing chart showing the operation of the head drive controller shown in FIG. 10.

FIG. 10 is a block diagram illustrating the detailed construction of the head drive controller 115, and FIG. 11 is a timing chart indicating the operation of the head drive controller 115.

In FIG. 10, numeral 251 is a timing generator which outputs a timing pulse Tc of the frequency of approximately 20 μs. The frequency of the timing pulse Tc is arbitrary, if the nozzles of 8 blocks of the recording head 1 can be driven within the driving frequency of the recording head 1 (185 μs in the embodiment).

Numeral 252 is a counter which is reset at the fall of the timing pulse Tc and counts a clock 1T inputted from the divider 102.

Numerals 253–256 are registers which respectively store data corresponding to the head drive time corresponding to each ink. The data of the registers 253–256 are set by the CPU 101.

Numerals 257–260 are comparators which outputs "1" in the case where the count value is greater than the data when a count value is inputted from the counter 252 to each terminal A and the data of the registers 253–256 are respectively inputted to each terminal B. That is, the counter 252 is shared by all the nozzles.

Numeral 261–264 are J-K F/Fs which respectively output "1" when the timing pulse Tc inputted to the terminal J rises. Subsequently, when "1" is inputted from registers 257–260 to the terminal K, "0" is outputted.

Numeral 265–268 are AND gates which respectively output the AND of the timing pulse Tc and each output of the J-K F/Fs 261–264. The outputs of the AND gates 265–268 become the drive pulse-width signal S12 of the frequency corresponding to the data of the registers 253–256.

Accordingly, in the embodiment, since the recording heads having a series of nozzles, for four colors arranged in a line, are used, the following advantages can be obtained in comparison with the conventional ink-jet printer.

(1) The width of the printer body can be reduced.

(2) The registration in the main scanning direction is not needed.

(3) The non-volatile memory which stores registration correction values is not needed.

(4) Since the counter for head drive pulse can be shared by all the nozzles, the control circuit of the recording heads can be simplified.

(5) The recording heads and the cost of a printer can be reduced.

Furthermore, since a recording head is comprised of 24-nozzle groups for Y, M and C and a 64-nozzle group for K, when a document including only text is printed in black, the printing speed is as fast as that of the ink-jet printer having a conventional head construction.

Accordingly, in the embodiment, registration in the main scanning direction and a non-volatile memory which stores the registration correction values are not used since a part of the control circuit is commonly used. Thus, the control structure of the recording head can be simplified, the cost of the recording head and printer can be reduced, and the control structure can be adopted by a color ink-jet printer for a lap top type or note book type personal computer.

[Second Embodiment]

The second embodiment according to the present invention is described below. In the second embodiment, the portions which are identical to those in the first embodiment have the same reference numerals, and the description is not needed.

Figure 12:
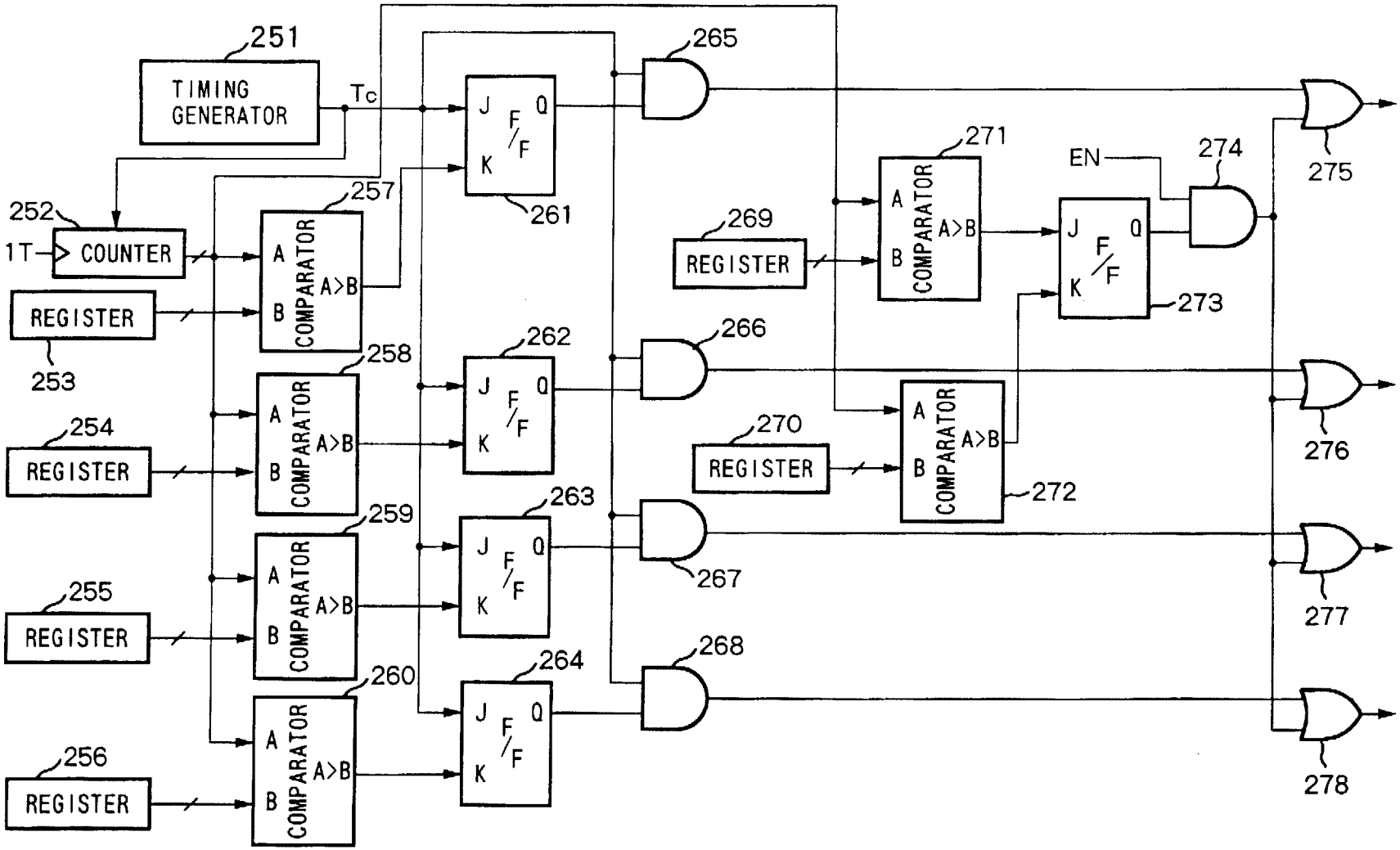
FIG. 12 is a block diagram illustrating the detailed construction of the head drive controller of a second embodiment according to the present invention.
Figure 13:
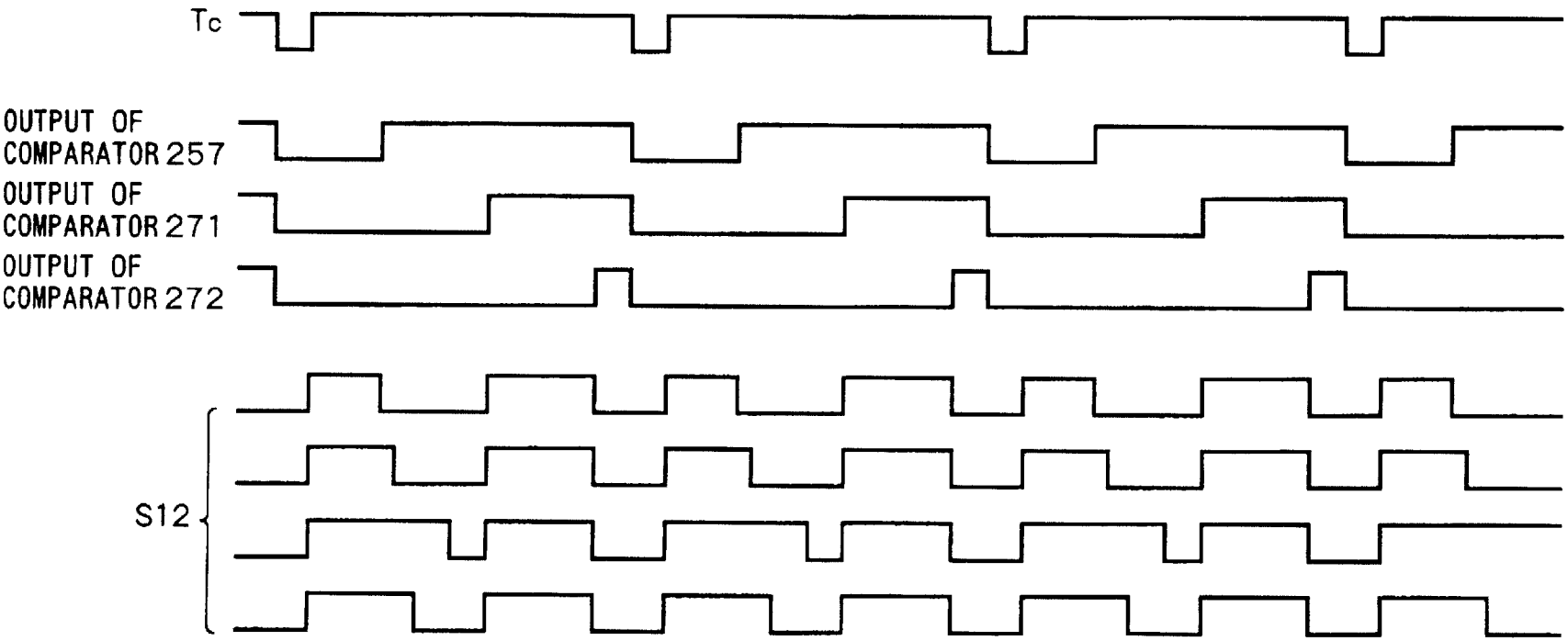
FIG. 13 is a timing chart illustrating the operation of the head drive controller shown in FIG. 12.

FIG. 12 is a block diagram illustrating the detailed construction of the head drive controller 115, and FIG. 13 is a timing chart showing the operation of the head drive controller 115.

The head drive controller 115 of the embodiment can output a single pulse or double pulse as a drive pulse signal S12 as shown in FIG. 13. The first pulse of a double pulse is controlled in its width in accordance with the temperature of the recording head 1 so that the ink discharge amount will be constant. The pulse-width of the second pulse is set in accordance with the discharge amount at the room temperature. The pulse-width of second pulse is a width which is not related to an ink color and unique to the recording head 1. More particularly, the width of the first pulse is reduced along with temperature increase of the recording head 1. Accordingly, when there is a high printing rate, such as when graphics and photographic images are recorded, since the temperature rise of the recording head 1 increases, the width of the first pulse decreases. That is, an accurate control is possible and fine printing result can be obtained by separately controlling the pulse-width which is unique to the recording head 1 and the pulse-width depending on the temperature of the recording head 1. The temperature rise of the recording head 1 can be predicted by monitoring the number of ink discharge operations, similar to the first embodiment.

Figure 14:
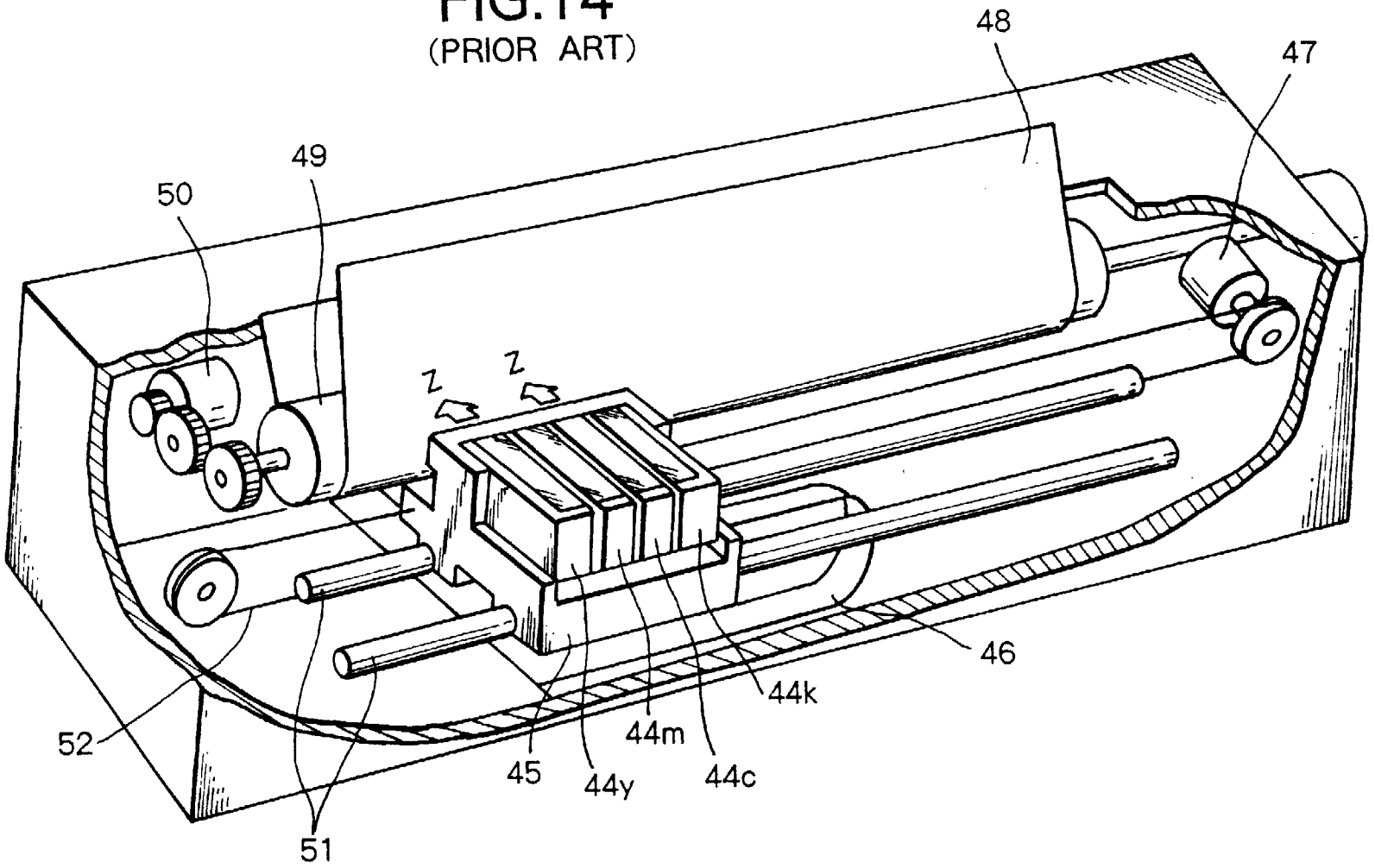
FIG.14 (PRIOR ART)
FIG. 14 is a perspective view illustrating the construction of a general color ink-jet printer.

In the ink-jet printer having the conventional head construction as shown in FIG. 14, since the recording heads of each color are separated, the second pulse-width needs to be set in each recording head. Furthermore, since a registration mechanism needs to be independently provided to correspond to the recording head, the driving pulse is independently generated. Accordingly, drive pulse generators are separately needed for each color concerning the second pulse.

However, in the embodiment, since the nozzles for each color are arranged in line, driving pulses can be generated in synchronism and a single counter can be shared in each color. Furthermore, since the second pulse-width is common in all the colors, as shown in FIG. 12, a second pulse can be generated by adding some additional elements to the head drive controller 115 of the first embodiment. The additional elements are a pair of registers 269 and 270, comparators 271 and 272, J-K F/F 273, AND gate 274 and OR gates 275–278.

In FIG. 12, a signal EN is a selection signal for a double pulse and a single pulse. When the signal EN is "1", the head drive controller 115 generates a double pulse.

Accordingly, the second embodiment has the similar advantage to the first embodiment. Moreover, since a double pulse is generated, accurate control is possible and fine printing result can be obtained.

Furthermore, in the recording apparatus of the second embodiment, the control of a drive pulse-width to control driving energy of the nozzle in accordance with each nozzle group can be performed by using a single counter. Thus, the cost of the head drive control circuit can be reduced.

Furthermore, the recording apparatus of the embodiment can variably control drive energy for ink discharge in each nozzle group by providing a data register for the pule width set in accordance with each nozzle group, while using the same counter.

Still further, the control apparatus of the embodiment can share a part of control registers in all the nozzles or a part of the nozzles. The control register discharges an ink droplet from the corresponding nozzle by applying a plurality of drive pulses, and defines the pulse-widths of the plurality of drive pulses corresponding to each nozzle group.

The present invention provides (excellent) effects especially in a printing apparatus having an ink-jet recording head of the type in which printing is performed by forming flying droplets utilizing thermal energy.

With regard to a typical configuration and operating principle, it is preferred that the foregoing be achieved using the basic techniques disclosed in the specifications of U.S. Pat. Nos. 4,723,129 and 4,740,796. This scheme is applicable to both so-called on-demand-type and continuous-type apparatus. In particular, in the case of the on-demand type, at least one drive signal, which provides a sudden temperature rise that exceeds that for film boiling, is applied, in accordance with print information, to an electrothermal transducer arranged to correspond to a sheet or fluid passage holding a fluid (ink). As a result, thermal energy is produced in the electrothermal transducer to bring about film boiling on the thermal working surface of the recording head. Accordingly, air bubbles can be formed in the fluid (ink) in one-to-one correspondence with the drive signals. A discharging port is made to discharge the fluid (ink) by growth and contraction of the air bubbles so as to form at least one droplet. If the drive signal has the form of a pulse, growth and contraction of the air bubbles can be made to take place rapidly and in appropriate fashion. This is preferred since it will be possible to achieve fluid (ink) discharging having excellent response.

Signals described in the specifications of U.S. Pat. Nos. 4,463,359 and 4,345,262 are suitable as drive pulses having this pulse shape. It should be noted that even better printing can be performed by employing the conditions described in the specification of U.S. Pat. No. 4,313,124, which discloses an invention related to the rate of increase in the temperature of the above-mentioned thermal working surface.

In addition to the combination of the discharging port, fluid passage and electrothermal transducer (in which the fluid passage is linear or right-angled) disclosed as the construction of the recording head in each of the above-mentioned specifications, the present invention covers also an arrangement using the art described in the specifications of U.S. Pat. Nos. 4,558,333 and 4,459,600, which disclose elements disposed in an area in which the thermal working portion is curved.

Further, it is permissible to adopt an arrangement based upon Japanese Patent Application Laid-Open No.

59-123670, which discloses a configuration having a common slot for the discharging portions of a plurality of electrothermal transducers, or Japanese Patent Application Laid-Open No. 59-138461, which discloses a configuration having openings made to correspond to the discharging portions, wherein the openings absorb pressure waves of thermal energy.

Furthermore, as a full-line type recording head having the length corresponding to the maximum recording width for a recording apparatus, the length of the recording head can be comprised of a plurality of recording heads as disclosed in the specification or a single recording head.

It is permissible to use a freely exchangeable chip-type recording head attached to the main body of the apparatus and capable of being electrically connected to the main body of the apparatus and of supplying ink from the main body, or a cartridge-type recording head in which an ink tank is integrally provided on the recording head itself.

The addition of recovery means for the recording head and spare auxiliary means provided as components of the printing apparatus of the invention is desirable since these stabilize the effects of the invention greatly. Specific examples of these means that can be mentioned are capping means for capping the recording head, cleaning means, pressurizing or suction means, and preheating means such as an electrothermal transducer or another heating element or a combination thereof. Implementing a preliminary discharging mode for performing discharging separately from recording also is effective in order to perform stabilized printing.

The printing mode of the printing apparatus is not limited merely to a printing mode for a mainstream color only, such as the color black. The recording head can have a unitary construction or a plurality of recording heads can be combined. The apparatus can be one having at least one recording mode for a plurality of different colors or for full-color recording using mixed colors.

Further, ink is described as being the fluid in the embodiments of the invention set forth above. The ink used may be one which solidifies at room temperature or lower, or one which liquefies at room temperature. Alternatively, in an ink-jet arrangement, generally the ink is temperature-controlled by regulating the temperature of the ink itself within a temperature range of between 30° C. and 70° C. so that the viscosity of the ink will reside in a region that allows stable discharging of the ink. Therefore, it is permissible to use an ink which liquefies when the printing signal is applied.

In order to positively prevent elevated temperature due to thermal energy when this is used as the energy for converting the ink from the solid state to the liquid state, or in order to prevent evaporation of the ink, it is permissible to use an ink which solidifies when left standing. In any case, the present invention is applicable also in a case where use is made of an ink which solidifies in response to application of thermal energy, such as an ink solidified by application of thermal energy conforming to a printing signal or ink which has already begun to solidify at the moment it reaches the recording medium. Such inks may be used in a form in which they oppose the electrothermal transducer in a state in which they are held as a liquid or solid in the recesses or through-holes of a porous sheet, as described in Japanese Patent Application Laid-Open Nos. 54-56847 and 60-71260. In the present invention, the most effective method of dealing with these inks is the above-described method of film boiling.

Furthermore, as to the form of the printing apparatus according to the present invention, use is not limited to an image output terminal of an image processing apparatus such as a word processor or computer described above. Other configurations, which may be provided as a separate or integral part, include a copying machine in combination with a reader or the like, a facsimile machine having a transmitting/receiving function, etc.

In the embodiment, the ink-jet recording type is adopted, however, this does not impose a limitation upon the invention. For example, the invention can be applied to a thermal-sensitive recording type or a thermal transfer recording type.

Furthermore, the invention can be applied not only to a color recording, but also gray scale recordings in a color using its dark color and light color, and in different colors using their dark colors and light colors. That is, the invention can be applied to any recording using the recording heads whose recording elements respectively corresponding to colors at least in hue, intensity and saturation are arranged in line.

The present invention can be applied to a system constituted by a plurality of devices or to an apparatus comprising a single device. Furthermore, it goes without saying that the invention is applicable also to a case where the object of the invention is attained by supplying a program to a system or apparatus.

As many apparently widely different embodiments of the present invention can be made without departing from the spirit and scope thereof, it is to be understood that the invention is not limited to the specific embodiments thereof except as defined in the appended claims.

What is claimed is:

1. A recording apparatus which performs recording of data by using a recording head having plural groups of recording elements which are arranged in a line, each group having a plurality of recording elements which are supplied with driving signals, said apparatus comprising:

a plurality of storing and determining means for storing respective data corresponding to each of the plural groups and for determining pulse-widths of the driving signals for each group;

a common counter, shared by the plural groups, for generating a signal for setting the pulse-widths of the driving signals determined by said plurality of storing and determining mean; and a control circuit for controlling the pulse-widths of the driving signals in accordance with the data stored in said plural storing and determining means and the signal generated by said common counter, which are respectively supplied to each group of recording elements.

2. The apparatus according to claim 1, wherein said common counter generates the signal in a predetermined frequency, and the signal generated in the predetermined frequency is obtained by dividing a clock which controls the timing of an operation of said control circuit.

3. The apparatus according to claim 2, wherein said plural storing and determining means are registers for respectively setting values for the pulse-widths of the driving signals corresponding to each of the plural groups.

4. The apparatus according to claim 3, wherein said control circuit turns on the driving signals in synchronism with the clock, and turns off the driving signals corresponding to each of the plural groups, in accordance with a comparison result of a count value of the common counter and the values respectively set in the registers corresponding to each of the plural groups.

5. The apparatus according to claim 4, wherein a color of ink discharged by the recording elements of any one of the plural groups differs from colors of ink discharged from others of the plural groups.

6. The apparatus according to claim 5, wherein the color is one of yellow, magenta, cyan and black.

7. The apparatus according to claim 5, wherein the color is one of a deep and light color of a same color.

8. The apparatus according to claim 3, wherein a value is set in accordance with a temperature in the registers.

9. The apparatus according to claim 1, wherein said control circuit comprises a common register, shared by the plural groups, which sets the pulse-widths of the driving signals.

10. The apparatus according to claim 9, further comprising:

a clock which controls operational timing, wherein a value is set in said common register and said control circuit turns on the driving signals in synchronism with said clock, generates a comparison result of a count value of signals, obtained by dividing said clock, in a predetermined frequency and the value set in said common register, and turns off the driving signal in accordance with the comparison result.

11. The apparatus according to claim 10, wherein a color of ink discharged by the recording elements of any one of the plural groups differs from colors of ink discharged from others of the plural groups.

12. The apparatus according to claim 11, wherein the color is one of yellow, magenta, cyan and black.

13. The apparatus according to claim 11, wherein the color is one of a deep and light color of a same color.

14. The recording apparatus according to claim 9, wherein said control circuit comprises a plurality of register which set other pulse-widths of the driving signals corresponding to each of the plural groups.

15. The apparatus according to claim 14, wherein a value is set in accordance with a temperature in the plurality of registers.

16. The apparatus according to claim 1, wherein said recording head is an ink-jet recording head which performs recording by discharging ink.

17. The apparatus according to claim 16, wherein said recording head is a recording head which discharges an ink droplet by utilizing thermal energy, and includes a thermal transducer to generate the thermal energy for the ink.

18. The apparatus according to claim 17, wherein said recording head comprises a discharge port and effects a state change of ink by the thermal energy applied to said thermal energy transducer, and discharges the ink through the discharge port based on the state change.

19. A recording apparatus which performs recording of data by using a recording head having plural groups of recording elements which are arranged in a line, each group having a plurality of recording elements which are supplied with driving signals, said apparatus comprising:

a clock generation circuit for generating clock pulses defining an operational timing;

a plurality of registers for storing data corresponding to respective groups and for setting corresponding values for the pulse-widths of the driving signals supplied to each group of recording elements;

a counter for counting the clock pulses, said counter defining an output timing of the driving signals and issuing a common count value; and a plurality of signal generation circuits for generating driving signals having pulse-widths corresponding to each group based on the set value of each of said registers and the common count value of the counter.

20. The apparatus according to claim 19, wherein a color of ink discharged by the recording elements of any one of the plural groups differs from colors of ink discharged from others of the plural groups.

21. The apparatus according to claim 20, wherein the color is one of yellow, magenta, cyan and black.

22. The apparatus according to claim 11, wherein the color is one of a deep and light color of a same color.

23. The apparatus according to claim 19, wherein the recording elements corresponding to different groups are plural, and the plurality of recording elements are divided into a plurality of blocks.

24. The apparatus according to claim 23, wherein the recording elements of each of said blocks are not adjacent to each other.

25. The apparatus according to claim 19, wherein said recording head is an ink-jet recording head which performs recording by discharging ink.

26. The apparatus according to claim 25, wherein said recording head is a recording head which discharges an ink droplet by utilizing thermal energy, and includes a thermal transducer to generate the thermal energy for the ink.

27. The apparatus according to claim 26, wherein said recording head comprises a discharge port and effects a state change of the ink by the thermal energy applied to said thermal energy transducer, and discharges the ink through the discharge port based on the state change.

28. The apparatus according to claim 19, further comprising comparison means for outputting a comparison result obtained by comparing the common count value with the value set in each of said registers, wherein said plurality of signal generation circuits turns on the driving signals in synchronism with the clock pulses, and turns off the driving signals in accordance with the comparison result.

29. The apparatus according to claim 19 wherein a value is set in accordance with a temperature in the plurality of registers.

30. A recording apparatus which performs recording of data by using a recording head having plural groups of recording elements which are arranged in a line, each group having a plurality of recording elements which are supplied with driving signals, said apparatus comprising:

a clock generation circuit for generating clock pulses defining an operational timing;

a plurality of registers for storing data corresponding to respective groups and for setting corresponding values for the pulse-widths of driving signals commonly supplied to each group of recording elements;

a counter for counting the clock pulses, said counter defining an output timing of the driving signals and outputting a count value; and a signal generation circuit for inputting the values set in the registers and the count value of the counter, and commonly generating the driving signals of the pulse-widths corresponding to different groups based on the values set in the registers and the count value.

31. The apparatus according to claim 30, wherein a color of ink discharged by the recording elements of any one of the plural groups differs from colors of ink discharged from others of the plural groups.

32. The apparatus according to claim 31, wherein the color is one of yellow, magenta, cyan and black.

33. The apparatus according to claim 31, wherein the color is one of a deep and light color of a same color.

34. The apparatus according to claim 30, wherein the recording elements corresponding to different groups are plural, and the plurality of recording elements are divided into a plurality of blocks.

35. The apparatus according to claim 34, wherein the recording elements of lack of said block are not adjacent to each other.

36. The apparatus according to claim 30, wherein said recording head comprises an ink-jet recording head which performs recording by discharging ink.

37. The apparatus according to claim 36, wherein said recording head comprises a recording head which discharges an ink droplet by utilizing thermal energy, and includes a thermal transducer to generate the thermal energy for the ink.

38. The apparatus according to claim 36, wherein said recording head comprises a discharge port and effects a state change of the ink by the thermal energy applied by said thermal energy transducer, and discharges the ink through the discharge port based on the state change.

39. The apparatus according to claim 30, further comprising comparison means for outputting a comparison result obtained by comparing a common count value output by said counter with the value set in each of said registers, wherein said signal generation circuit turns on the driving signals in synchronism with the clock pulses, and turns off the driving signals in accordance with the comparison result.

40. The apparatus according to claim 30, further comprising:

a plurality of additional registers for setting values of another pulse-width of the driving signals supplied to each group of recording elements; and a plurality of signal generation circuits for inputting the values set in the plurality of the additional registers and a common count value of the counter, and generating the driving signals of the other pulse-width corresponding to each group based on each of the set values of the plurality of additional registers and the common count value.

41. The apparatus according to claim 40, wherein a value is set in accordance with a temperature in the plurality of additional registers.

* * * * *

UNITED STATES PATENT AND TRADEMARK OFFICE

CERTIFICATE OF CORRECTION

PATENT NO. : 5,903,289

DATED : May 11, 1999

INVENTOR(S) : YOSHIAKI TAKAYANAGI

It is certified that error appears in the above-identified patent and that said Letters Patent is hereby corrected as shown below:

Title page,

References cited [56]

U.S. PATENT DOCUMENTS

Please insert the following:

| | | |
|---|---|---|
| --4,313,124 | 1/1982 | Hara |
| 4,345,262 | 8/1982 | Shirato et al. |
| 4,459,600 | 7/1984 | Sato et al. |
| 4,463,359 | 7/1984 | Ayata et al. |
| 4,558,333 | 12/1985 | Sugitani et al. |
| 4,608,577 | 8/1986 | Hori |
| 4,723,129 | 2/1988 | Endo et al. |
| 4,740,796 | 4/1988 | Endo et al.--. |

FOREIGN PATENT DOCUMENTS

Please insert the following:

| | | |
|---|---|---|
| --54056847 | 5/1979 | Japan |
| 59123670 | 7/1984 | Japan |
| 59138461 | 8/1984 | Japan |
| 60071260 | 4/1985 | Japan--. |

UNITED STATES PATENT AND TRADEMARK OFFICE

CERTIFICATE OF CORRECTION

PATENT NO. : 5,903,289

DATED : May 11, 1999

INVENTOR(S) : YOSHIAKI TAKAYANAGI

It is certified that error appears in the above-identified patent and that said Letters Patent is hereby corrected as shown below:

ABSTRACT [57]

Line 10, "the" should be deleted.

COLUMN 1

Line 63, "periphery" should read --periphery of--.

COLUMN 3

Line 20, "plate" should read --plate 1a--.

COLUMN 4

Line 41, "Si" should read --S1--.

COLUMN 6 Line 44, "outputs" should read --output--.

UNITED STATES PATENT AND TRADEMARK OFFICE

CERTIFICATE OF CORRECTION

PATENT NO. : 5,903,289

DATED : May 11, 1999

INVENTOR(S) : YOSHIAKI TAKAYANAGI

It is certified that error appears in the above-identified patent and that said Letters Patent is hereby corrected as shown below:

COLUMN 7

Line 58, "the" should read --this--.

COLUMN 8

Line 6, "and" should read --and a--.
Line 33, "apparatus." should read --apparatuses.--.

COLUMN 10

Line 43, "mean;" should read --means;--.

COLUMN 12

Line 7, "claim 11," should read --claim 20.--.
Line 34, "claim 19" should read --claim 19,--.

UNITED STATES PATENT AND TRADEMARK OFFICE

CERTIFICATE OF CORRECTION

PATENT NO. : 5,903,289

DATED : May 11, 1999

INVENTOR(S) : YOSHIAKI TAKAYANAGI

It is certified that error appears in the above-identified patent and that said Letters Patent is hereby corrected as shown below:

COLUMN 13

Line 2, "lack of said block" should read --each of said blocks--.

Line 12, "claim 36," should read --claim 37,--.

Signed and Sealed this

Fifth Day of December, 2000

*Attest:*

*Attesting Officer*

Q. TODD DICKINSON

*Director of Patents and Trademarks*